US007257935B1

(12) United States Patent
Wehrmann

(10) Patent No.: US 7,257,935 B1
(45) **Date of Patent: *Aug. 21, 2007**

(54) SYSTEM FOR DISPENSING INFLATED PLASTIC DUNNAGE

(75) Inventor: Rick Steven Wehrmann, Hudson, OH (US)

(73) Assignee: Automated Packaging Systems, Inc., Streetsboro, OH (US)

( * ) Notice: Subject to any disclaimer, the term of this patent is extended or adjusted under 35 U.S.C. 154(b) by 528 days.

This patent is subject to a terminal disclaimer.

(21) Appl. No.: 10/717,392

(22) Filed: Nov. 18, 2003

Related U.S. Application Data

(60) Continuation of application No. 10/154,018, filed on May 23, 2002, now Pat. No. 6,672,037, which is a division of application No. 09/735,111, filed on Dec. 12, 2000, now Pat. No. 6,527,147.

(51) Int. Cl.
*B65B 3/02* (2006.01)

(52) U.S. Cl. ..... 53/469; 53/403; 53/79; 53/139.5; 53/284.7

(58) Field of Classification Search ..... 53/472, 53/403, 79, 139.5, 469, 284.7; 493/350, 493/352, 967, 464
See application file for complete search history.

(56) References Cited

U.S. PATENT DOCUMENTS 3,667,593 A * 6/1972 Pendleton ..... 206/584
5,693,163 A * 12/1997 Hoover et al. ..... 156/147
6,109,488 A * 8/2000 Horton ..... 222/636
6,199,349 B1 * 3/2001 Lerner ..... 53/472
6,405,893 B1 * 6/2002 Tobe et al. ..... 221/2
6,527,147 B2 * 3/2003 Wehrmann ..... 222/281
6,672,037 B2 * 1/2004 Wehrmann ..... 53/472
2005/0178085 A1 * 8/2005 Huis et al. ..... 53/403
2005/0235600 A1 * 10/2005 Perkins et al. ..... 53/79

* cited by examiner

*Primary Examiner*—Brian Nash
(74) *Attorney, Agent, or Firm*—Calfee Halter & Griswold LLP

(57) ABSTRACT

A system for providing dunnage to packages as the packages are formed is disclosed. The system includes a dunnage forming machine having a work station for inflating and sealing plastic pouches to form dunnage units. An accumulator is positioned below the station for receiving and collecting such units as they are formed. The accumulator includes an outlet opening laterally offset from the station. A pair of counter rotating brushes having axes journaled in spaced relationship are mounted at the outlet. Each of the brushes includes circumferentially spaced bristle sets defining unit receiving spaces between adjacent sets. A motor drive is operably connected to the brushes for causing counter rotation. A unit volume sensor is provided for emitting a machine start signal when the volume of units in the accumulator reaches a predetermined low volume. A process for providing dunnage in packages being formed is also disclosed.

4 Claims, 3 Drawing Sheets

SYSTEM FOR DISPENSING INFLATED PLASTIC DUNNAGE

This application is a continuation of U.S. application Ser. No. 10/154,018 filed May 23, 2002, now U.S. Pat. No. 6,672,037 which is a divisional application of U.S. Ser. No. 09/735,111 filed Dec. 12, 2000, now U.S. Pat. No. 6,527,147

TECHNICAL FIELD

This invention relates to dunnage dispensing for packaging and more particularly to a novel and improved process and apparatus for accumulating and dispensing individual dunnage units.

BACKGROUND

Many merchants, particularly those who sell wares through catalog and internet services, must package and ship individual orders. Standard size cartons are used. Since the individual orders vary in volume and weight and seldom completely fill a standard carton, it is necessary to provide dunnage to fill packages to protect the contents of packages during shipment.

Currently foamed plastic elements known as peanuts are widely used. Peanuts enjoy popularity because of their relatively small size and light weight. The small sizes provide ready filling of a wide range of sizes of spaces in packages being formed.

While peanuts are popular, they have distinct disadvantages. A major disadvantage, is that a substantial volume of storage space is required to maintain an inventory. A further major disadvantage is, in a large use environment a very substantial capital investment is required for delivering the peanuts to packaging stations.

A troublesome disadvantage is peanuts produce substantial quantities of dust. Further, because of their very light weight, the peanuts, when dispensed into packages, do not all find their way into packages being formed. Rather they create litter around each packaging station. Moreover, when a package is opened and the contents are removed, a customer opening such a package is invariably confronted with a clean-up job because peanuts are seemingly everywhere around the site where the package was opened.

U.S. Pat. Nos. RE36,501 and RE36,759 to Hoover et al. disclose and claim methods of making dunnage from a chain of interconnected bags (the Hoover Patents). Application Ser. No. 09/315,413 filed May 20, 1999 by Bernard Lerner, PCT application No. PCT/US00/13784 filed May 18, 2000 as a continuation-in-part thereof (The PCT Application), and a concurrently filed continuation-in-part of both (09/735,345) (The Continuation Application) each disclose improved methods and apparatus for producing dunnage units by inflating and sealing interconnected pouches. The Continuation Application is hereby incorporated in its entirety by reference.

The Hoover Patents and the referenced applications each disclose dunnage units which have tacky external surfaces that stick together. While such tacky dunnage units are highly advantageous for shipment of heavy products, for many packages such tackiness is not required. Moreover, such tackiness tends to be counterproductive to the supply of dunnage units at the rates of speed required by businesses which market products via catalogs and the internet, in that packaging must be accomplished with dispatch. Further, because the tacky units adhere to one another, rapid filling of voids in a package being created may be inhibited. In addition, there are many applications where tackiness is not required or desirable so that the provision of tackiness simply adds to the cost of the units.

BRIEF DESCRIPTION OF INVENTION

The process and apparatus of The Continuation Application are used to produce dunnage units. With this process a web of interconnected pouches is fed sequentially to position end ones of the pouches at a dunnage formation station. As dunnage units are formed at the formation station, they are dropped into an attached hopper or accumulator to provide and maintain a volume of dunnage units.

One of the outstanding advantages of the present system is that minimal space is provided for inventory of dunnage materials. This is so because the material consists of flattened plastic webs either in coils or in festooned form. Expressed another way, the present dunnage system permits a user to maintain an inventory which is not inflated by the storage of air as is the case with the popular peanuts and other dunnage systems.

When an operator forming a package desires to put dunnage units into a package, a motor is energized to drive a pair of dispensers in counter-rotation. The counter-rotating dispensers are in the form of brushes which dispense the dunnage units through an outlet opening at the base of the accumulator.

A foot switch is provided to enable a packager to cause dispensing of dunnage units from the accumulator while the packager's hands are free to shift the package being formed or to otherwise manually distribute the units into package spaces to be filled.

Preferably a preprogrammed timer is also provided. Through experience an operator will know the approximate time duration needed to dispense an appropriate number of units to fill spaces in a package being formed. The operator will then depress a button which causes the motor to be energized for a selected one of a number of available time periods. If needed, the package may then be "topped off" through motor energization by the foot switch. Use of an automatic timer enables the packager to perform other tasks as the dunnage units are dispensed.

The accumulator has a number of unique features. One of these is the provision of a deionizer for deionizing air around the dunnage formation station and in the hopper thereby minimizing static electricity in the dunnage units being formed. To further control static electricity, the hopper includes a conductive plate positioned adjacent the accumulator's receiving chamber further to reduce the presence of static electricity.

The brushes have circumferentially spaced spiral sets of bristles. When dunnage units are being dispensed from the accumulator through a dispensing outlet, units are trapped between adjacent but spaced sets of bristles so that a few units are dispensed while the brushes retain the remaining units in the accumulator.

In order to minimize interference with an operator's movements, the dispensing outlet is preferably laterally offset from and below the dunnage formation station. To assure adequate feed of dunnage units to the dispensing outlet, a lower wall of the hopper below the formation station is tapered downwardly toward the outlet. In addition, an air nozzle for directing a flow of air is provided. The air flow blows dunnage units from locations immediately below the formation station toward locations above the dispensing outlet.

The dunnage formation process is preformed independently of the unit dispensing. While the dispensing is intermittent as successive packages are filled at spaced time intervals, the unit formation is on an as needed basis up to continuous operation.

In the preferred arrangement, two vertically offset depth sensors are provided. When the volume of units in the hopper reaches a predetermined minimum level, the lower one of the two sensors signals the pouch formation machine to commence operation. When the volume of units reaches a predetermined maximum, the second and higher positioned one of the units, emits a stop signal to the dunnage formation machine. Thus, the volume of units in the hopper is maintained between maximum and minimum levels and the units are formed at a rate responsive to the demand for units.

Alternately, a single sensor can be provided which, for example, utilizes a light beam. When the beam is not interrupted a start signal is sent to the machine. When units in the hopper reach a level that interrupts the beam, a stop signal is sent to the machine.

Tests have shown that the efficiency of an operator experienced in using peanuts as dunnage material has a significant productivity increase when the process and apparatus of the present disclosure is practiced in lieu of the use of peanuts.

Accordingly, the objects of the invention are to provide a novel and improved system for and method of providing and dispensing dunnage units.

DESCRIPTION OF THE PREFERRED EMBODIMENT

Figure 1:
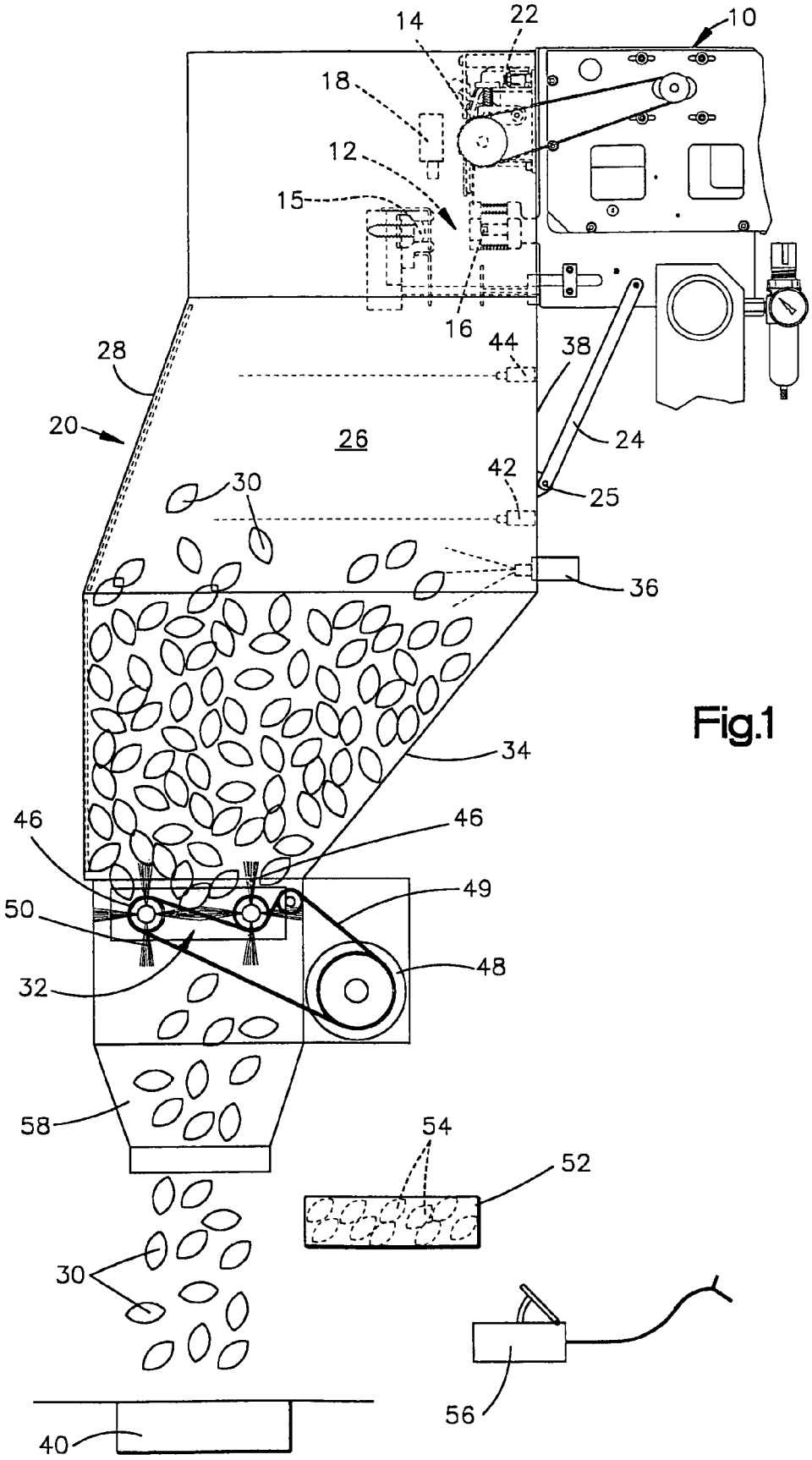
FIG. 1 is a side elevational view of the dunnage formation and accumulation system of the present invention.
Figure 2:
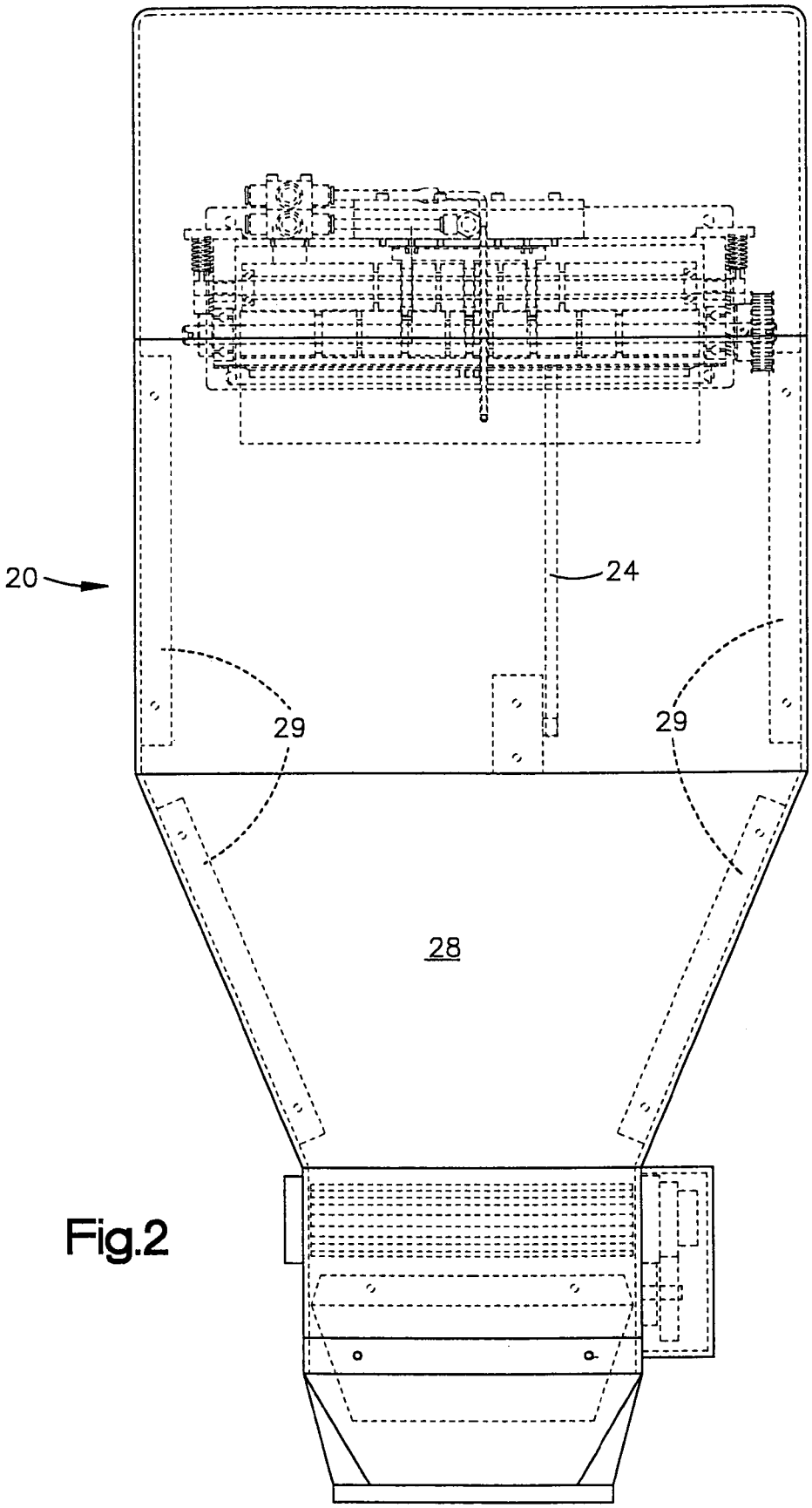
FIG. 2 is a front elevational view as seen from a plane indicated by the line 2-2 of FIG. 1; and, FIG. 3 is a side elevational view of that portion of the system that provides a dunnage formation station.
Figure 3:
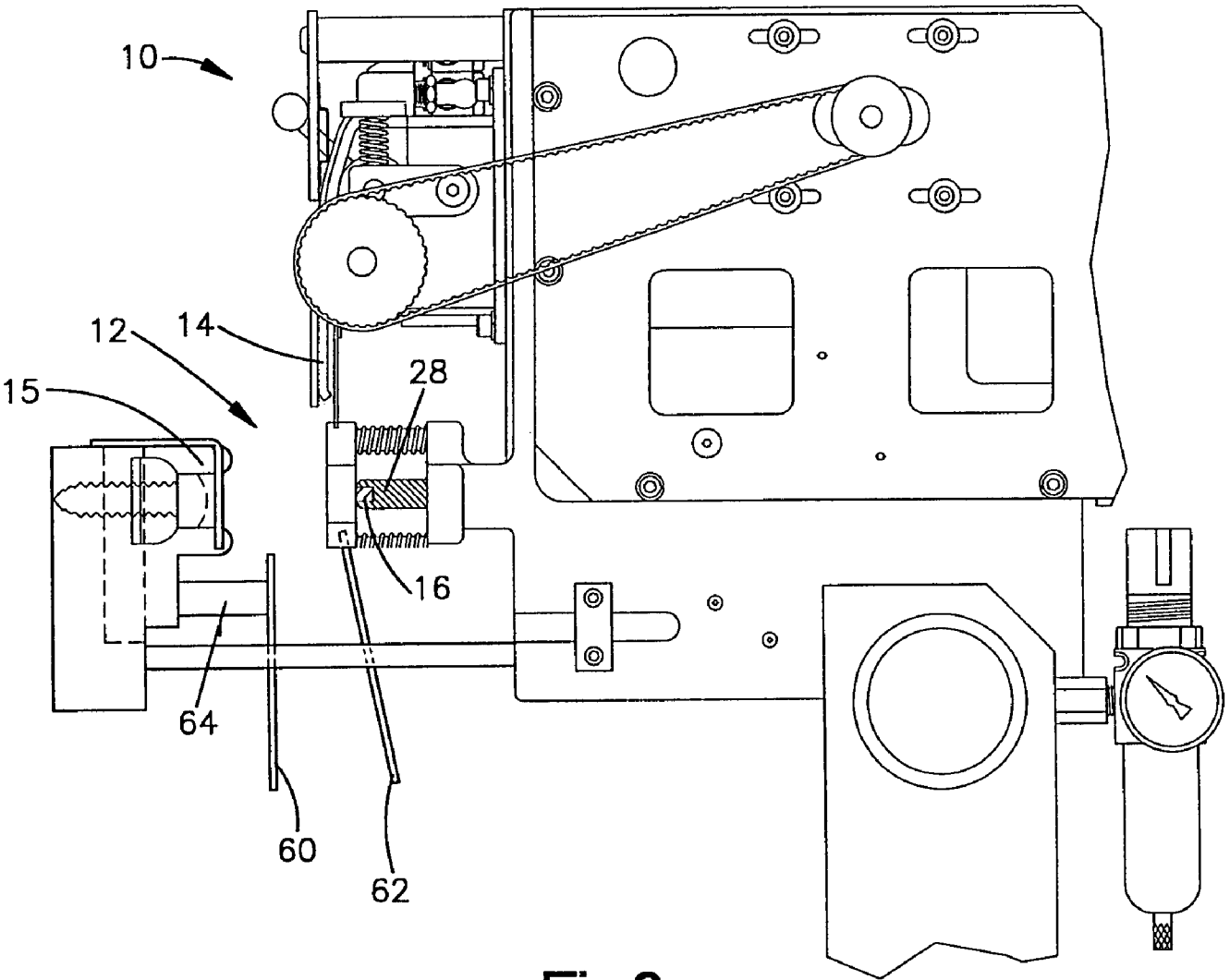

Referring now to the drawings and to FIG. 1 in particular, a somewhat schematic and fragmentary view of a dunnage forming machine is shown generally at 10. The machine 10 is described in greater detail as is its operation in The Continuation Application which has been incorporated by reference. The machine includes a work station 12 at which dunnage units are formed. Dunnage units are formed by successively positioning pouches at the formation station 12. In the now preferred arrangement shown in FIG. 3, the face and back plate 60, 62 delineate the front and back of the space in which pouches are inflated. A prime mover in the form of an air cylinder 64 moveably supports the face plate 60. The air cylinder is actuated to position the face plate 60 in the position shown in solid lines in FIG. 3. The pouches are opened and then inflated by a flow of air through an air supply tube 14. Once a pouch is inflated a seal pad 15 is moved from the left to the right as viewed in FIGS. 1 and 3 to clamp the top of an inflated pouch between a pad 15 and a seal bar 16'. The plates 60, 62 having served their function of controlling the volume of air in a pouch now being sealed, the cylinder 64 is energized to retract the plate 60.

A deionizer 18 is provided. The deionizer is a commercially available unit, sold by Simco Corp. Of 2257 N. Penn Road, Hatfield, Pa. 19440 under the designation Aerostat Cadet. The deionizer 18 is effective to deionize air emitted by the air supply tube 14 and thereby minimize the pressure of static electricity in the dunnage units being formed.

An accumulator shown generally at 20 is fixed to the machine 10 as by bolts, one of which is shown at 22 in FIG. 1. A brace 24 extends from the machine downwardly to a connection at 25 with a hopper 26 forming a part of the accumulator 20. The cylinder 64 is connected to the accumulator so that the cylinder and the face plate 60 are supported by the accumulator.

The hopper 26 has metal sides and back. A transparent hopper face 28 is secured to side flanges 29 to complete an accumulation chamber. In that the face 28 is transparent, an operator is able visually to determine to what extent the hopper is filled by dunnage units 30. In FIG. 1 there is some "artistic license" in that the dunnage units are shown in solid lines rather than dotted lines, it being recognized that the units are not visible through the metal sides of the hopper 26, but rather only through the face 28.

The hopper 26 includes an outlet 32 through which units 30 are dispensed. As an examination of FIG. 1 will show, the outlet 32 is below and laterally offset from the formation station 12. A reason for the forward offset of the outlet 32 is to facilitate positioning the outlet generally central of a package support (not shown) below the dunnage outlet. This enables an operator to shift the package being formed relative to the outlet to distribute dunnage units being dispensed into appropriate locations in a package being formed. Such a package is indicated schematically at 40.

Because the outlet is offset from the dunnage, a lower back wall portion 34 tapers downwardly and forwardly from a location below the formation station to a location adjacent the outlet. To further position dunnage units above the outlet after they have been dropped from the formation station, an air nozzle 36 is provided in a back wall 38 of the hopper. As is indicated schematically in FIG. 1, the air nozzle emits air which functions to blow dunnage units towards the front of the machine and over the dispensing opening.

A pair of unit sensors 42, 44 are provided. When the level of dunnage units in the hopper 20 is below a predetermined level, the lower sensor 42 emits a machine start signal to the forming machine 10. When dunnage units have accumulated to a level at which the upper sensor 44 is actuated, a machine stop signal is sent to the forming machine 10. While dispensing from the accumulator 20 is periodic according to the demands of an operator forming packages, the formation machine 10 functions independently of the dispensing. Thus, the machine 10 operates at intervals up to continuous operation appropriate to maintain the level of dunnage units in the hopper 20 within a predetermined and desired range. Expressed another way, the formation machine operates at rates adequate to meet demand but operates independently of dispensing from the accumulator.

One of the outstanding advantages of the system resides in the novel arrangement for dispensing units through the outlet 32. A pair of counter-rotating dispensers preferably in the form of brushes 46 is provided. The brushes 46 are driven by a motor 48 via a belt 49. The brushes 46 have spaced spirally disposed bristle sets 50. As can be seen by an examination of FIG. 1, the spaced bristle sets delineate the meets and bounds of spaces which receive units being dispensed, while at the same time maintaining other units within the hopper 26.

A control timer 52 is provided. The timer has a set of actuation buttons 54, each of which will cause energization of the motor 48 for a different predetermined time interval. In addition, a foot switch 56 is provided. Actuation of the foot switch will also cause operation of the motor 48 and consequent dispensing of the units 30.

Operation

In operation the dunnage formation machine is operated until a usable quantity of dunnage units 30 is dispensed into the hopper 26. An operator places products to be shipped to fill an order in a box to provide a package being formed 40. The package being formed 40 is then positioned below a funnel-like section 58 of the accumulator 20.

If the timer 52 is provided, an operator will, based on the operator's experience, determine the approximate time units should be dispensed to fill spaces in the package being formed 40. The operator will then depress the appropriate one of the buttons 54 to cause the motor 48 to be energized for that predetermined time. The motor drives the brushes 46 in counter rotation to dispense units 30 through the outlet 32. As this automatic dispensing of units is occurring the operator is free to perform other tasks such as commencing to form the next package to be completed.

When appropriate, the operator will shift the package being formed 40 to place package spaces needing units immediately below the funnel section 58. If the timed dispensing is inadequate fully to complete space filling in the package being formed 40, or if the unit does not have a control timer 52, the foot switch 56 is depressed to actuate the motor and cause dispensing of a sufficient quantity of units 30 to fill the package.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A system for providing dunnage to packages as the packages are formed comprising:

a) a dunnage forming machine having a formation station for inflating and sealing plastic pouches to form dunnage units;

b) an accumulator positioned below the station for receiving and collecting such units as they are formed;

c) the accumulator including an outlet opening laterally offset from the formation station;

d) a pair of counter rotating brushes having axes journaled in spaced relationship at the outlet, each of the brushes including circumferentially spaced bristle sets defining unit receiving spaces between adjacent sets;

e) a motor drive operably connected to the brushes for causing such counter rotation;

f) an operator controlled switch for selectively engaging the motor drive; and g) the accumulator including:

i) a bottom tapering downwardly from a location below the formation station toward the outlet;

ii) a mechanism for urging such units from the location toward the outlet; and iii) a unit volume sensor for emitting a machine start signal when the volume of units in the accumulator reaches a predetermined low volume, the signal being effective to cause the machine to produce dunnage units.

2. The system of claim 1 further including a second sensor for emitting machine stop signals when the volume of units in the accumulator reaches a predetermined high volume.

3. The system of claim 2 further including a deionizer mounted along an air supply path for minimizing formation of static electricity.

4. The system of claim 1 further including a deionizer mounted along an air supply path for minimizing formation of static electricity.

* * * * *